US007118632B2

(12) United States Patent
Sumonthee

(10) Patent No.: US 7,118,632 B2
(45) Date of Patent: Oct. 10, 2006

(54) POOL CLEANING METHOD AND DEVICE

(75) Inventor: Jirawat Sumonthee, West Palm Beach, FL (US)

(73) Assignee: Aqua-Vac Systems, Inc., West Palm Beach, FL (US)

( * ) Notice: Subject to any disclaimer, the term of this patent is extended or adjusted under 35 U.S.C. 154(b) by 308 days.

(21) Appl. No.: 10/853,295

(22) Filed: May 26, 2004

(65) Prior Publication Data

US 2005/0262652 A1 Dec. 1, 2005

(51) Int. Cl.
*E04H 4/16* (2006.01)

(52) U.S. Cl. ..... 134/6; 15/1.7

(58) Field of Classification Search ..... 15/1.7; 134/6

See application file for complete search history.

(56) References Cited

U.S. PATENT DOCUMENTS 4,168,557 A * 9/1979 Rasch et al. ..... 15/1.7
4,849,024 A 7/1989 Supra
5,099,535 A * 3/1992 Chauvier et al. ..... 15/1.7
5,197,158 A 3/1993 Moini
5,337,434 A 8/1994 Erlich
5,351,355 A * 10/1994 Chiniara ..... 15/1.7
5,435,031 A 7/1995 Minami et al.
5,569,371 A * 10/1996 Perling ..... 210/85
5,985,156 A 11/1999 Henkin et al.
6,090,219 A 7/2000 Henkin et al.
6,115,864 A * 9/2000 Davidsson et al. ..... 15/1.7
6,125,492 A 10/2000 Prowse
6,280,611 B1 8/2001 Henkin et al.
6,299,699 B1 10/2001 Porat et al.
6,365,039 B1 4/2002 Henkin et al.
6,387,250 B1 5/2002 Henkin et al.
6,412,133 B1 7/2002 Erlich et al.
6,485,638 B1 11/2002 Henkin et al.
6,652,742 B1 11/2003 Henkin et al.
6,842,931 B1 * 1/2005 Porat et al. ..... 15/1.7
2002/0116772 A1 8/2002 Phillipson et al.
2004/0021439 A1 2/2004 Porat et al.

* cited by examiner

*Primary Examiner*—Mark Spisich

(57) ABSTRACT

A method and a device for cleaning the bottom and sides of a swimming pool having a housing with front and rear ends and opposite sides, a pair of motor driven cylindrical brushes rotatably secured to the front and rear ends of the housing, a suction pump disposed within the housing, and a floatation element disposed within the housing and secured to one side of the housing.

6 Claims, 4 Drawing Sheets

POOL CLEANING METHOD AND DEVICE

BACKGROUND OF THE INVENTION

The present invention relates to swimming pools and, more specifically, a method and device for cleaning the bottom and sides of swimming pools.

Swimming pools commonly require significant maintenance. Beyond the treatment and filtration of the pool water, the pool bottom and sides must be scrubbed. Additionally, leaves and other debris often elude the pool filter and must be removed with a net. Because maintaining a pool can be tedious, cleaning devices have been developed that randomly navigate about the pool, scrubbing the pool bottom and sides and removing debris that has settled on the pool bottom.

Pool cleaning devices typically navigate about the bottom of a swimming pool in random manner until, after several hours, the cleaning device has covered most if not all of the pool. Some devices, such as U.S. Pat. No. 6,299,699 to Porat et al., employ complex electronics and global positioning systems to propel the cleaning devices in an efficient and orderly manner. Because of the complex electronics, cleaning devices as these typically are expensive and not a practical option for most consumers.

To vary the path of the cleaning device as it navigates about the pool, some conventional devices use a buoyant handle that causes the cleaning device to slightly veer off path as the device climbs the side of the pool. For instance, U.S. Pat. No. 5,337,434 to Erlich discloses a device with a buoyant handle disposed at an angle with respect to the normal direction of movement. The disadvantage of using a buoyant handle is that direction of the cleaning device only is affected as the device climbs the side of the pool and not while the device traverses the pool bottom.

U.S. Pat. No. 5,197,158 to Moini discloses a cleaning device with a pair of swing arms that, upon impact with an obstruction or the sides of the pool, cause the cleaning device to stop and travel in a reverse direction. The disadvantage with the Moini device is that the cleaning device only travels on the pool bottom and does not clean the sides of the pool.

Some cleaning devices use complex mechanical components to vary the path of the device while traveling on the pool bottom. For instance, U.S. Pat. No. 5,337,434 to Erlich teaches the use of a hydraulic leg that partially lifts one side of the cleaning device such that the device pivots about the hydraulic leg. Another device, such as U.S. Pat. No. 5,435,031 to Minami et al. teaches the use of independent drive tracks. By varying the speed of each drive track, the cleaning device can turn on the pool bottom in much the same way that a military tank steers and navigates. The disadvantage of these devices is that they require complex mechanical components in order to vary the direction of the cleaning devices while traveling on the pool bottom. As such, there is a need in the art for an improved pool cleaning device that can clean both the bottom and sides of a swimming pool without the need for complex mechanical or electronic components.

It is therefore a principal object of this invention to provide a pool cleaning device that can pivot with respect to the bottom of a swimming pool without the need for separate drive tracks, pivot legs, or other complex components.

A further object of this invention is to provide a floatation element secured to one side of the pool cleaning device and a suction pump whereby varying the operation of the suction pump allows the floatation element to partially lift and turn the pool cleaning device whiwhile the device is traversing the bottom of the swimming pool.

These and other objects will be apparent to those skilled in the art.

BRIEF SUMMARY OF THE INVENTION

The present invention is directed toward a device for cleaning the bottom and sides of a swimming pool. A housing is provided with a front end, a rear end, and opposite sides. A pair of motor driven cylindrical brushes are rotatably secured to the front and rear ends of the housing, and a suction pump is disposed within the housing. Additionally, the pool cleaning device includes a floatation element disposed within the housing and secured to one side of the housing. The present invention also is directed toward a method for cleaning a swimming pool.

DESCRIPTION OF THE PREFERRED EMBODIMENT OF THE INVENTION

Figure 1:
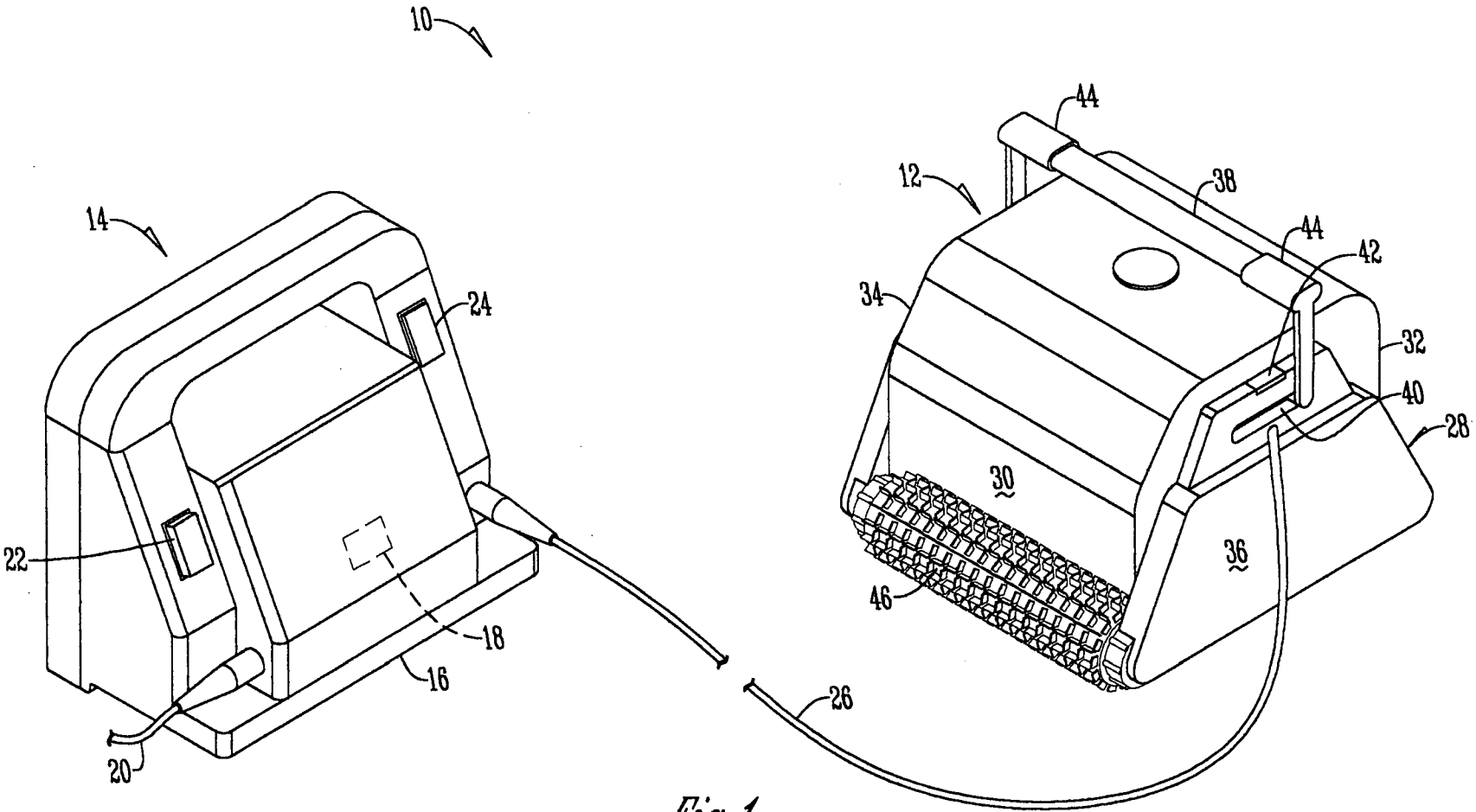
FIG. 1 is a perspective drawing of the power supply unit and pool cleaning device of the present invention.

With reference to FIG. 1, a pool cleaning system 10 is disclosed that comprises a submersible pool cleaning device 12 and a power supply unit 14. The power supply unit 14 includes a housing 16 and a programmable logic controller (PLC) 18 disposed therein. Electrical power is provided to the PLC 18 via electrical conduit 20, which is removably secured to the housing 16 of the power supply unit 14. Operation of the pool cleaning system 10 is regulated by a power switch 22, and the specific operation of the pool cleaning device 12 is regulated by the timer switch 24, as discussed hereafter. The pool cleaning device 12 is connected to the power supply unit 14 via electrical conduit 26, which is removably secured to both the pool cleaning device 12 and the power supply unit 14.

Figure 2:
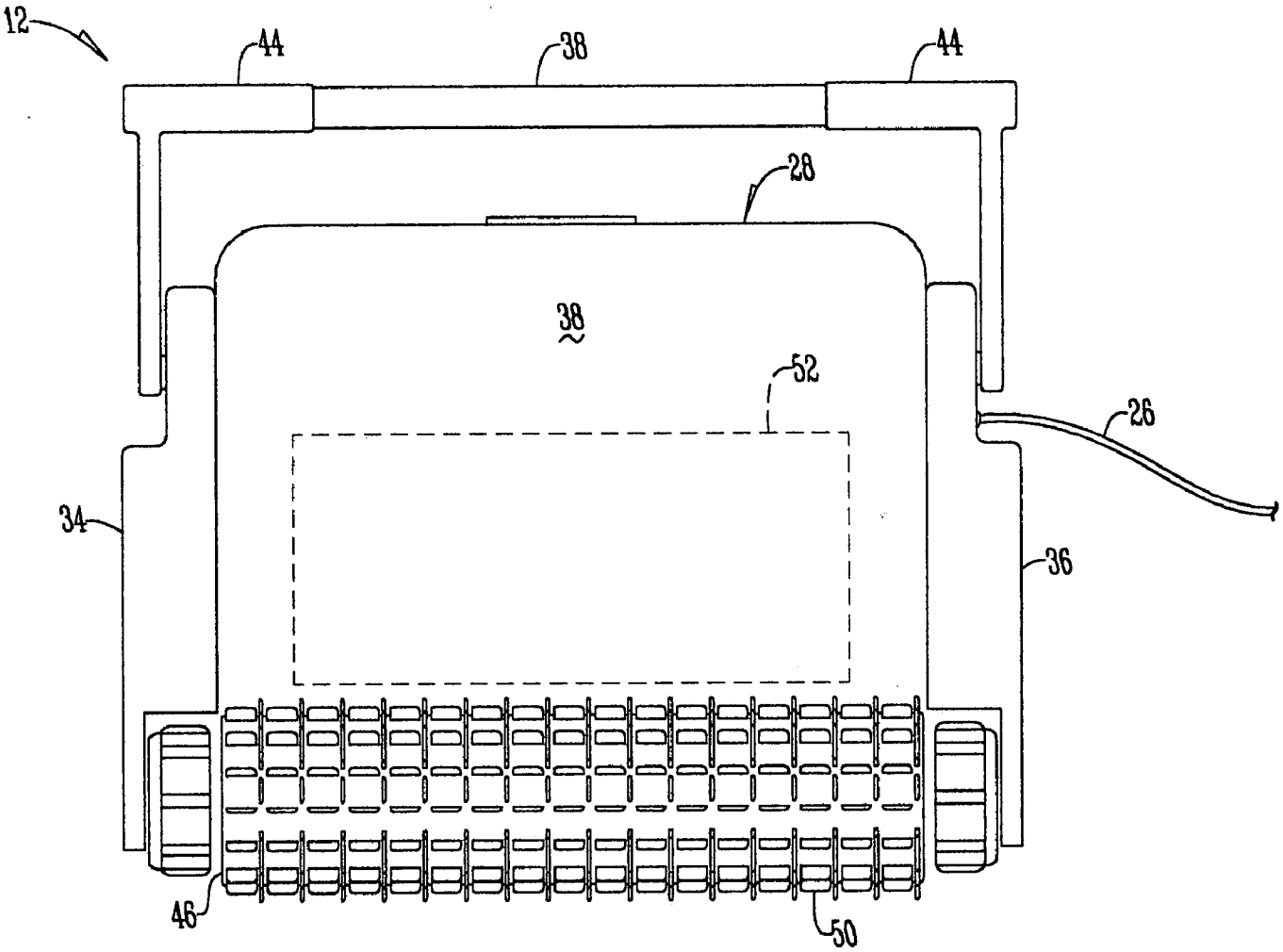
FIG. 2 is a front view of the pool cleaning device of the present invention.
Figure 3:
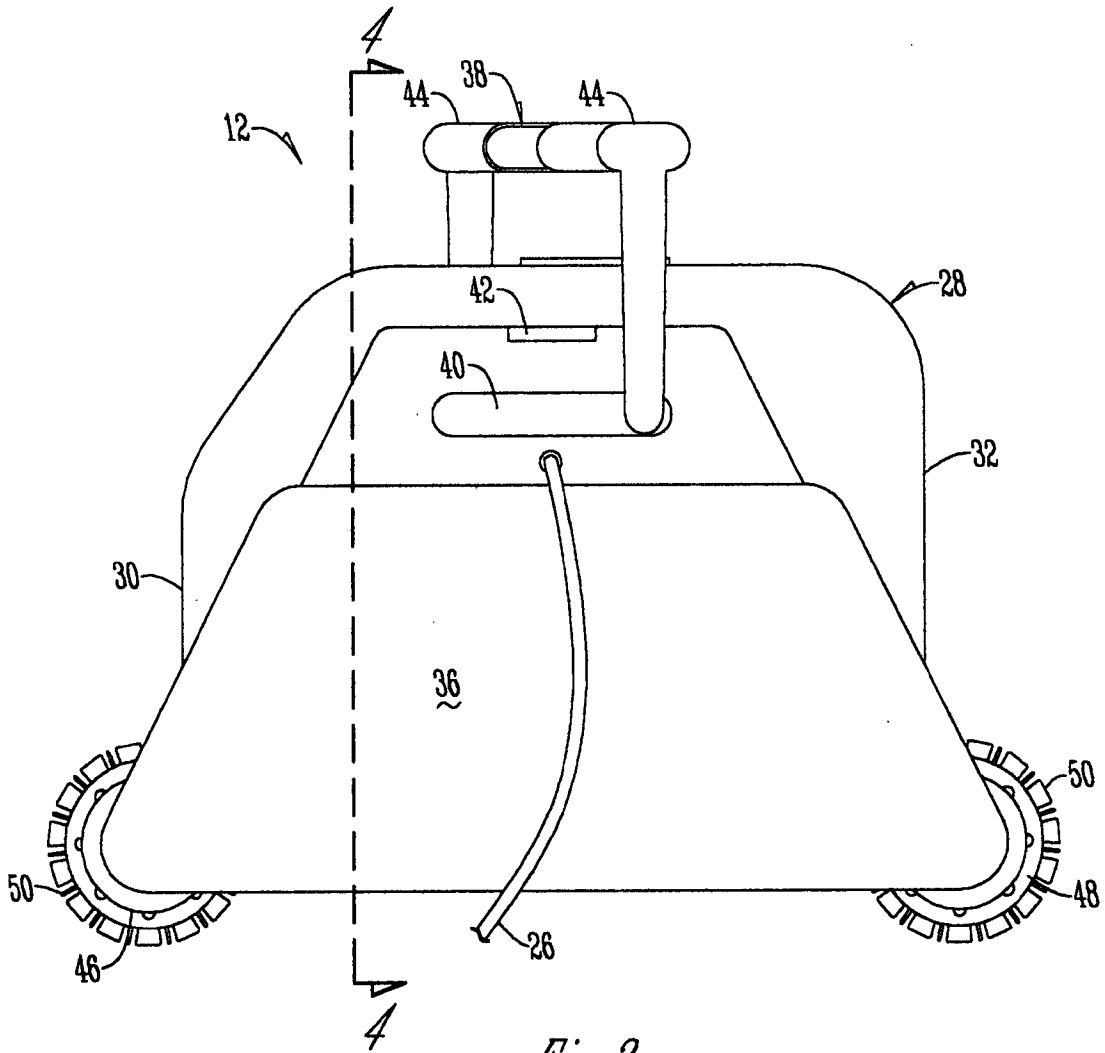
FIG. 3 is a side view of the pool cleaning device of the present invention.
Figure 4:
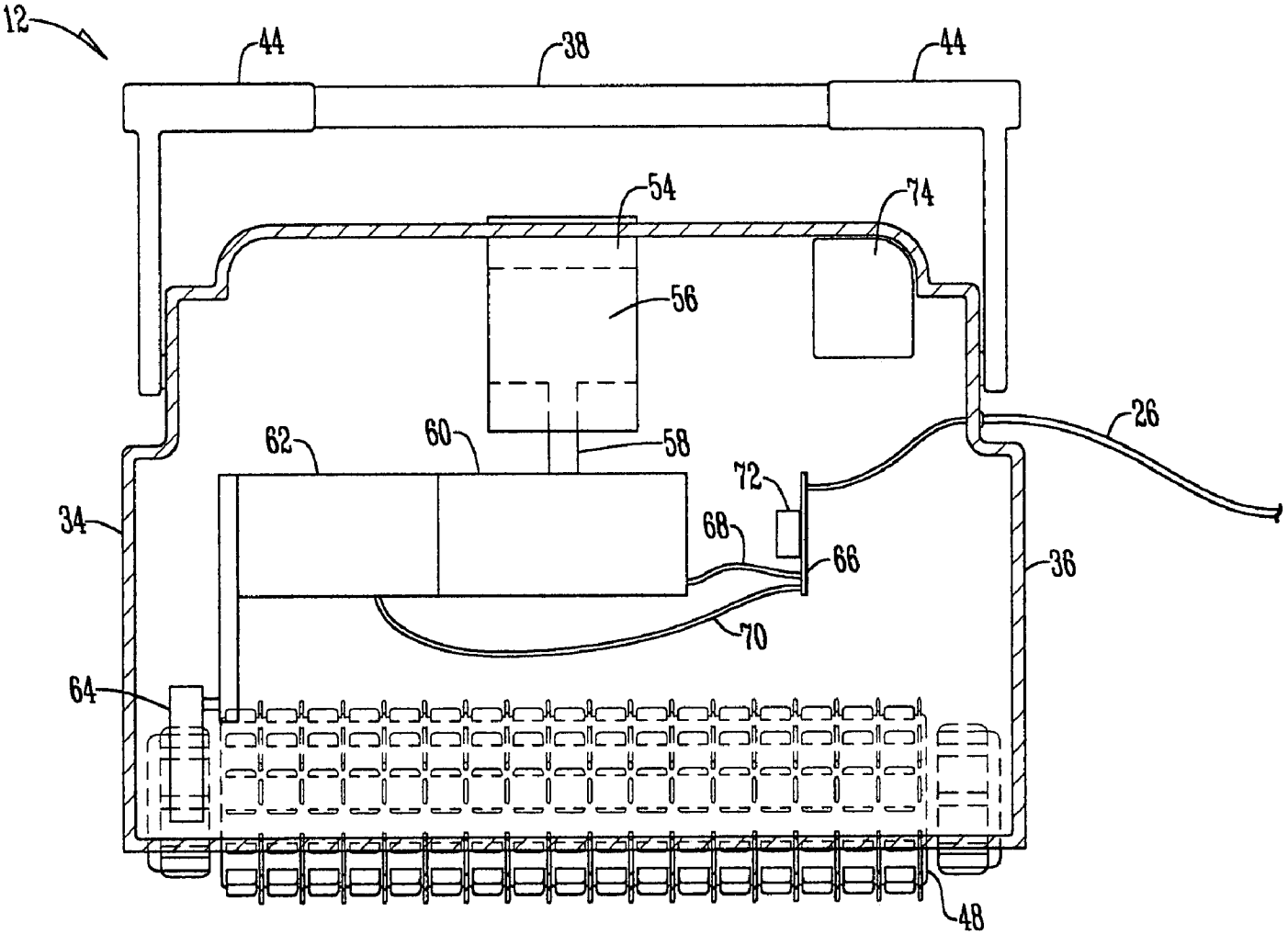
FIG. 4 is a sectional view of the pool cleaning device of the present invention taken along line 4—4 of FIG. 3.

With reference to FIGS. 2–4, the pool cleaning device 12 includes a housing 28 having a front end 30, rear end 32, and opposite sides 34 and 36.

A handle 38 is slidably secured to the housing 28 of the pool cleaning device 12. Specifically, handle 38 fits within slidable tracks 40 located within the sides 34 and 36 of the housing 28. A locking switch 42 secures the handle 38 in one of a plurality of positions. The handle 38 is preferably disposed at a slight angle with respect to the front 30 of the pool cleaning device 12. Handle 38 also includes buoyant portions 44 which maintain the handle 38 in an upright position and, depending upon the position of the handle 38 in slidable track 40, the buoyant portions 44 affect the performance of the pool cleaning device 12, as discussed hereafter.

A pair of cylindrical brushes 46 and 48 are rotatably secured to the housing 28 of the pool cleaning device 12. Specifically, cylindrical brush 46 is rotatably secured to the front 30 of housing 28, and brush 48 is secured to the rear 32. Cylindrical brushes 46 and 48 propel the pool cleaning device 12 across the bottom and sides of a swimming pool.

Additionally, cylindrical brushes 46 and 48 include resilient bristles 50 that provide the pool cleaning device 12 with traction and allow the cylindrical brushes 46 and 48 to scrub the pool bottom and sides as the pool cleaning device 12 navigates about the swimming pool.

A filter 52 is disposed within the housing 28 of the pool cleaning device 12 and removably secures to the housing 28 above cylindrical brush 46. In this arrangement, debris retrieved by cylindrical brush 46 is deposited into the filter 52. The filter 52 is removable from the bottom of the housing 28 of the pool cleaning device 12.

A suction pump 54 is disposed with the housing 28 and secured above the cylindrical brushes 46 and 48, as shown in FIG. 4. Suction pump 54 includes an impeller 56 that is secured to a drive shaft 58. Suction pump 54 is driven by a suction pump motor 60. Specifically, suction pump motor 60 turns drive shaft 58, which turns the impeller 56, thereby driving suction pump 54. Suction pump 54 draws water passing over the cylindrical brushes 46 and 48 and forces the water out through the top of the housing 28 of the pool cleaning device 12. In this manner, debris is pulled into the pool cleaning device 12 via the brushes 46 and 48 and deposited into the filter 52 as the water is drawn through the pool cleaning device 12 via suction pump 54.

A drive motor 62 is disposed within the housing 28 and positioned adjacent to the suction pump motor 60, as shown in FIG. 4. Drive motor 62 is operatively connected to the cylindrical brushes 46 and 48 via gears 64. In this arrangement, cylindrical brushes 46 and 48 operate together.

A printed circuit board 66 is disposed within the housing 28, proximate to motors 60 and 62, as shown in FIG. 4. Circuit board 66 is connected to electrical conduit 26. Additionally, circuit board 66 is connected to leads 68 and 70, which are connected to suction pump motor 60 and drive motor 62, respectively.

A microprocessor 72 is mounted to the circuit board 66 and is in electronic communication with PLC 18 in power supply unit 14 via electrical conduit 20. Additionally, microprocessor 72 is in electronic communication with motors 60 and 62 via lead wires 68 and 70, respectively. In this arrangement, PLC 18 controls and regulates the operation of motors 60 and 62 via microprocessor 72.

A floatation element 74 is disposed within the housing 28 of pool cleaning device 12 and secured to side 36 of the housing 28 above cylindrical brushes 46 and 48, as shown in FIG. 4. Floatation element 74 is preferably comprised of expanded polystyrene (EPS), but may be made of any buoyant material. Floatation element 74 is buoyant such that it provides lifting force to side 36 of the pool cleaning device 12, thereby partially lifting cylindrical brushes 46 and 48. Specifically, when the suction pump 54 is disabled, the buoyancy of the floatation element 74 creates a slight floatation differential within the pool cleaning device 12, thereby causing side 36 to lift from the pool bottom. When the suction pump 54 is operational, however, the flow of water through the pool cleaning device 12 overcomes the floatation differential created by the buoyancy of the floatation element 74, thereby causing the cylindrical brushes 46 and 48 to fully engage with the pool bottom.

In operation, the pool cleaning device 12 propels across the pool bottom depending upon the specific instructions of the PLC 18 in the power supply unit 14. When the suction pump 54 is operational, the flow of the water through the pool cleaning device 12 allows the cylindrical brushes 46 and 48 to fully engage the pool bottom and propel the pool cleaning device 12 in a straight line path across the pool bottom. However, when the suction pump 54 is disabled, floatation element 74 lifts side 36 of the pool cleaning device, which partially lifts brushes 46 and 48 from the pool bottom. With cylindrical brushes 46 and 48 only partially engaged with the pool bottom, the rotation of cylindrical brushes 46 and 48 causes the pool cleaning device 12 to pivot with respect to the pool bottom. In this manner, the pool cleaning device 12 can turn while navigating about the pool bottom.

Additionally, the pool cleaning device 12 can clean the sides of a swimming pool. Specifically, when the pool cleaning device 12 encounters the side of the pool while navigating about the pool bottom, the cylindrical brushes 46 and 48 pull the pool cleaning device 12 up the side of the pool. The thrust created by the suction pump 54 holds the pool cleaning device 12 against the side of the pool, and the buoyant portions 44 of the handle 38 assist the pool cleaning device 12 in its ascension. Because the handle 38 is disposed at a slight angle with respect to the front 30 of the housing 28, the pool cleaning device 12 tends to veer slightly off path as it ascends the side of the pool, depending upon the specific position of the handle 38 in slidable track 40. Upon reaching the surface of the water, the buoyant portions 44 of the handle 38 will carry the pool cleaning device 12 laterally with respect to the side of the pool until the PLC 18 reverses the direction of the drive motor 62. Upon reversal, the drive motor 62 propels the pool cleaning device down the side of the pool and towards the pool bottom. Because of the specific position of the handle 38 in slidable track 40, the pool cleaning device 12 will be sent on a slightly different path across the pool bottom than the device 12 took prior to climbing the side of the pool.

The PLC 18 is programmed to allow the pool cleaning device 12 to clean both the pool bottom and sides in the manner described above. Specifically, by selecting the "full" mode via timer switch 24, the PLC 18 will vary the operation of the suction pump 54 for a ninety-minute period such that the pool cleaning device 12 remains on the pool bottom. By varying the operation of the pool cleaning device 12, the floatation element 74 is allowed to periodically lift side 36 of the pool cleaning device 12 such that the cylindrical brushes partially lift and turn with respect to the pool bottom. After ninety minutes, the PLC 18 operates the suction pump 54 continuously for a second ninety-minute period, thereby allowing the pool cleaning device 12 to clean the sides of the pool. During this second ninety-minute period, the pool cleaning device 12 is not allowed to turn while passing over the pool bottom. The direction of the pool cleaning device 12 is affected completely by the buoyant portions 44 of handle 38 upon ascending the sides of the pool and reaching the surface of the water.

Alternatively, by selecting the "quick" mode via timer switch 24, the PLC 18 will only operate the pool cleaning device 12 for a total of ninety minutes, during which time the PLC 18 varies the operation of the suction pump 54. In this manner, the pool cleaning device 12 only navigates about the bottom and not the sides of the pool during the "quick" cleaning mode. Because of the versatility of PLC 18, virtually any number of cleaning modes in addition to the "full" and "quick" modes disclosed above may be programmed into PLC 18 to affect the operation of suction pump 54 and performance of the pool cleaning device 12.

It is therefore seen that by the use of a floatation element secured to one side of a pool cleaning device and a variable suction pump, this invention provides a pool cleaning device that can pivot with respect to the pool bottom without the need for separate drive tracks, pivot legs, or other complex components.

What is claimed is:

1. A device for cleaning the bottom and sides of a swimming pool comprising:

a housing with a front end, a rear end, a first side and a second side opposite the first side, wherein the first and second sides extend between the front and rear ends;

a pair of motor driven cylindrical brushes rotatably secured to the front and rear ends of the housing, wherein the cylindrical brushes are positioned parallel to the front and rear ends;

a suction pump disposed within the housing; and a floatation element disposed within the housing and secured to the first side of the housing above the cylindrical brushes, wherein when the suction pump is disabled, the floatation element creates a floatation differential within the device thereby causing the first side to lift from the bottom of the pool and the device to pivot with respect to the pool bottom, and wherein when the suction pump is operational, a flow of water through the device overcomes the floatation differential, thereby causing the cylindrical brushes to engage with the bottom of the pool.

2. The device of claim 1 further comprising a remotely located controller in communication with the suction pump.

3. Directional control means for a swimming pool cleaning device having a housing with front and rear ends, a first side and a second side opposite the first side, and wherein the first and second sides extend between the front and rear ends, a pair of motor driven cylindrical brushes rotatably secured to the front and rear ends of the housing, wherein the cylindrical brushes are positioned parallel to the front and rear ends for propelling the cleaning device along the bottom of the swimming pool, the directional control means comprising:

a floatation element disposed within the housing and secured to the first side of the housing and above the cylindrical brushes; and a suction pump disposed within the housing wherein disabling operation of the suction pump allows the floatation element to partially lift one side of the cleaning device from the pool bottom causing the cleaning device to pivot with respect to the pool bottom.

4. The directional control means of claim 3 further comprising a remotely located controller in communication with the suction pump for varying the operation of the suction pump.

5. A method of cleaning the bottom and sides of a swimming pool comprising:

providing a cleaning device having a housing with front and rear ends a first side and a second side opposite the first side, wherein the first and second sides extend between the front and rear ends, a pair of motor driven cylindrical brushes rotatably secured to the front and rear ends of the housing, wherein the cylindrical brushes are positioned parallel to the front and rear ends, and a floatation element disposed within the housing and secured to the first side of the housing above the cylindrical brushes;

disabling the suction pump to allow the floatation element to partially lift the first side of the cleaning device from the pool bottom causing the cleaning device to pivot with respect to the pool bottom; and operating the suction pump to allow the first and second sides of the cleaning device to engage the pool bottom causing the cleaning device to move in a straight line path across the pool bottom.

6. The method of claim 5 further comprising providing a remotely located controller in communication with the suction pump for varying the operation of the suction pump.

* * * * *